US008938904B1

(12) United States Patent
Sellers et al.

(10) Patent No.: US 8,938,904 B1
(45) Date of Patent: Jan. 27, 2015

(54) UNIVERSAL BORE SIGHT

(71) Applicants: James J. Sellers, Mansfield, TX (US); William K. Mellon, Grand Prairie, TX (US); Li Daohai, Chengdu (CN)

(72) Inventors: James J. Sellers, Mansfield, TX (US); William K. Mellon, Grand Prairie, TX (US); Li Daohai, Chengdu (CN)

(73) Assignee: Sellmark Corporation, Mansfield, TX (US)

( * ) Notice: Subject to any disclaimer, the term of this patent is extended or adjusted under 35 U.S.C. 154(b) by 0 days.

(21) Appl. No.: 13/795,799

(22) Filed: Mar. 12, 2013

Related U.S. Application Data

(60) Division of application No. 13/385,758, filed on Mar. 6, 2012, now Pat. No. 8,484,880, which is a continuation of application No. 12/221,795, filed on Aug. 6, 2008, now Pat. No. 8,132,354.

(60) Provisional application No. 61/025,784, filed on Feb. 3, 2008.

(51) Int. Cl.
*F41G 1/54* (2006.01)

(52) U.S. Cl.
CPC ..... *F41G 1/54* (2013.01)
USPC ..... 42/116

(58) Field of Classification Search
USPC ..... 42/116, 121; 33/292, 286, 293, DIG. 1, 33/DIG. 21, 263
See application file for complete search history.

(56) References Cited

U.S. PATENT DOCUMENTS 3,068,573 A 12/1962 Sidwell
3,112,567 A 12/1963 Flanagan
3,510,965 A 5/1970 Rhea
3,782,832 A 1/1974 Hacskaylo
4,057,905 A 11/1977 Piaja
4,090,305 A 5/1978 Cassidy
4,136,956 A 1/1979 Eichweber
4,234,911 A 11/1980 Faith
4,367,516 A 1/1983 Jacob
4,530,162 A 7/1985 Forrest et al.
4,750,269 A 6/1988 Townsend et al.
4,825,258 A 4/1989 Whitson
4,879,814 A 11/1989 Wallace et al.
5,001,836 A 3/1991 Cameron et al.
5,144,487 A * 9/1992 Hersey ..... 359/629
5,150,527 A 9/1992 Knoster
5,365,669 A 11/1994 Rustick et al.
5,396,708 A 3/1995 Whitley (Continued)

*Primary Examiner* — Reginald Tillman, Jr.
(74) *Attorney, Agent, or Firm* — Law Office of William Gustavson, PC

(57) ABSTRACT

A bore sight (10) is provided that can be used with many calibers of firearms (12) to align optical devices such as rifle scopes. The bore sight (10) has a housing (22) with a spring loaded arbor (26) extending from one end thereof. The arbor (26) has a tapered face (32) varying in diameter in a range including popular calibers, such as .17 to .50 caliber. The arbor (26) is inserted in the end (20) of the barrel (18) as far as the caliber of the barrel (18) permits. The arbor (26) then starts retracting into the housing (22) against the spring force to allow the magnetic alignment face (24) of the housing to move into contact with the end (20) of the barrel to align the bore sight (10) with the centerline of the bore (16). A laser (30) on the bore sight (10) then projects a laser beam aligned with the bore centerline, allowing alignment of the optical device. Bore sight (100) forms a second embodiment and does not have an arbor (26). The bore sight (100) is hand centered on the end of the barrel and is fixed thereto by the attraction of the magnetic alignment face (24) to the barrel (18).

7 Claims, 6 Drawing Sheets

(56) References Cited

U.S. PATENT DOCUMENTS

| | | | | |
|---|---|---|---|---|
| 5,432,598 | A | 7/1995 | Szatkowski | |
| 5,446,535 | A | 8/1995 | Williams | |
| 5,448,834 | A | 9/1995 | Huang | |
| 5,454,168 | A | 10/1995 | Langner | |
| 5,486,913 | A | 1/1996 | Aharon | |
| 5,568,265 | A | 10/1996 | Matthews | |
| 5,618,099 | A | 4/1997 | Brubacher | |
| 5,787,631 | A | 8/1998 | Kendall | |
| 6,282,806 | B1 | 9/2001 | Kable et al. | |
| 6,289,624 | B1 | 9/2001 | Hughes et al. | |
| 6,295,753 | B1 | 10/2001 | Thummel | |
| 6,397,509 | B1 | 6/2002 | Langner | |
| 6,421,947 | B1 | 7/2002 | Fuller | |
| 6,513,257 | B2 | 2/2003 | Nejad-Sattari | |
| 6,513,275 | B1 * | 2/2003 | Paige | 42/120 |
| 6,606,797 | B1 | 8/2003 | Gandy | |
| 6,643,019 | B1 * | 11/2003 | Jeanneret | 356/399 |
| D490,872 | S * | 6/2004 | Langner | D22/109 |
| 2001/0029675 | A1 * | 10/2001 | Webb | 33/286 |
| 2002/0062570 | A1 | 5/2002 | Palumbo et al. | |
| 2006/0265929 | A1 | 11/2006 | Haney | |

* cited by examiner

.50 Cal
.17 Cal 10
12
14
16
18
20
26

UNIVERSAL BORE SIGHT

CROSS REFERENCE TO RELATED APPLICATIONS

This application is a divisional of U.S. patent application Ser. No. 13/385,758 filed Mar. 6, 2012, which is a continuation of U.S. patent application Ser. No. 12/221,795 filed Aug. 6, 2008, now U.S. Pat. No. 8,132,354 issued Mar. 13, 2012, which claims priority from Provisional Patent Application Ser. No. 61/025,784 filed Feb. 3, 2008.

TECHNICAL FIELD

This invention relates to an optical sighting device, particularly for a firearm

BACKGROUND OF THE INVENTION

Quite often, firearms use optical sighting devices, such as telescopic rifle scopes, for more accurate targeting. In order to align these sighting devices with the physical point of impact of the bullet at a given range, laser bore sighting devices are often used, such as disclosed in U.S. Pat. No. 5,432,598.

Laser bore sights currently use two methods of attachment to the firearm. The first method has a tapered arbor that centers the laser to the firearm bore via the muzzle bore, as in U.S. Pat. No. 5,432,598. A second method allows the laser bore sighter to take the shape of a bullet casing and to be inserted into the breach of the firearm, as in U.S. Pat. No. 5,787,631.

Both methods require separate pieces for each caliber of firearm being tested. In the first method, the arbor must be sized to fit the particular caliber being tested. In the second method, the shape of the sighter must conform to the shape of the chamber in the receiver in which it is used. Thus, both methods require multiple pieces, assemblies or units to test the various caliber firearms commonly used today. Even so called universal bore sights are not useable on all calibers without multiple attachments.

A need exists to reduce the cost and complexity of these optical sighting alignment devices.

SUMMARY OF THE INVENTION

In accordance with one aspect of the present invention, a bore sight is provided for alignment with a member having a bore of predetermined diameter and an end having an annular surface lying in a plane generally perpendicular the centerline of the bore. The bore sight includes a housing having a planar surface lying in a first plane. In one version, an arbor is provided having a tapered face that can be at least partially inserted within the bore. The tapered face has a diameter within a range from a first, smaller diameter, to a second, larger diameter, the arbor mounted in the housing for movement along a first direction perpendicular to the first plane. The bore sight is positioned with the planar surface of the housing in contact with the annular surface of the end of the member. With no arbor, the bore sight is hand centered on the end. With the arbor, the arbor is moved along the first direction to insert the tapered face as far as the diameter of the bore in the member permits, thereby aligning the bore sight with the bore of the member.

In accordance with another aspect of the present invention, the member is a firearm. In accordance with another aspect of the present invention, the first, smaller diameter is 0.17 inches and the second, larger diameter is 0.50 inches In accordance with yet another aspect of the present invention, the bore sight has a spring to urge the arbor in the first direction and into the bore of the member. The housing can have a magnet at the planar surface to secure the bore sight in engagement with the member. A laser can be mounted in the housing that projects a beam aligned with the centerline of the bore when the bore sight is aligned with the member. Circuitry, a battery and a switch to operate the laser can be mounted in the housing. The arbor can be made of material that will not damage the member, such as brass or plastic.

BRIEF DESCRIPTION OF THE DRAWINGS

A more complete understanding of the invention and its advantages will be apparent from the following Detailed Description, taken in conjunction with the accompanying Drawings, in which.

DETAILED DESCRIPTION

Figure 1:
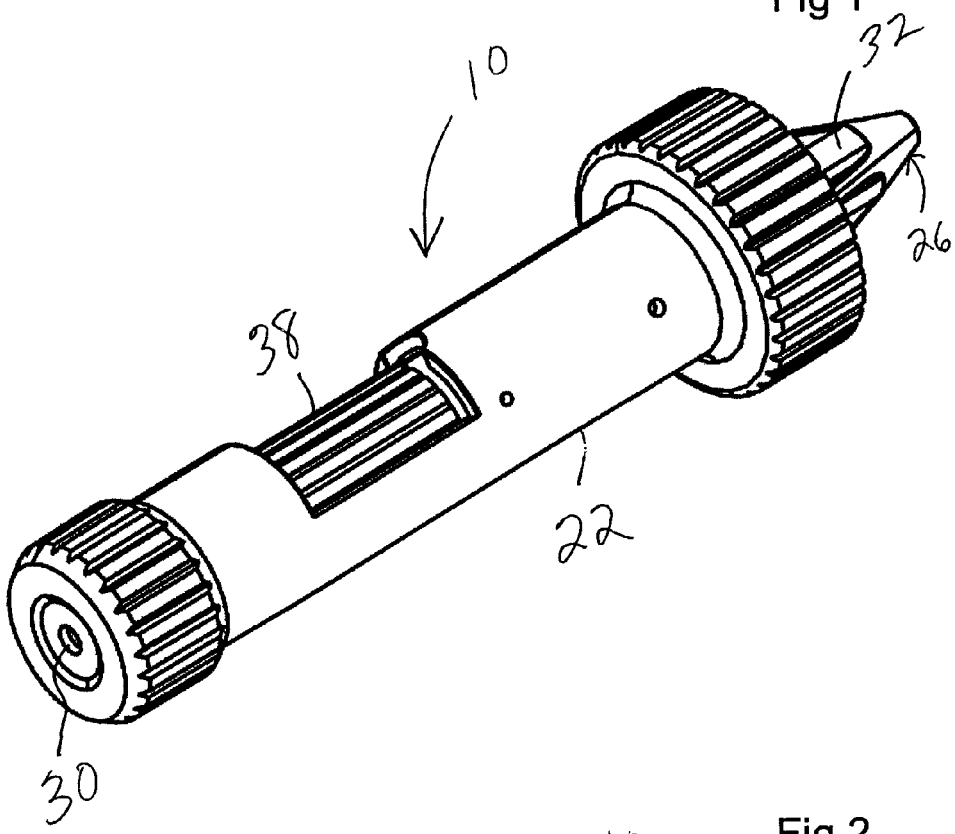
FIG. 1 is a front perspective view of a bore sight forming a first embodiment of the present invention, showing the laser, battery compartment and part of the arbor.
Figure 2:
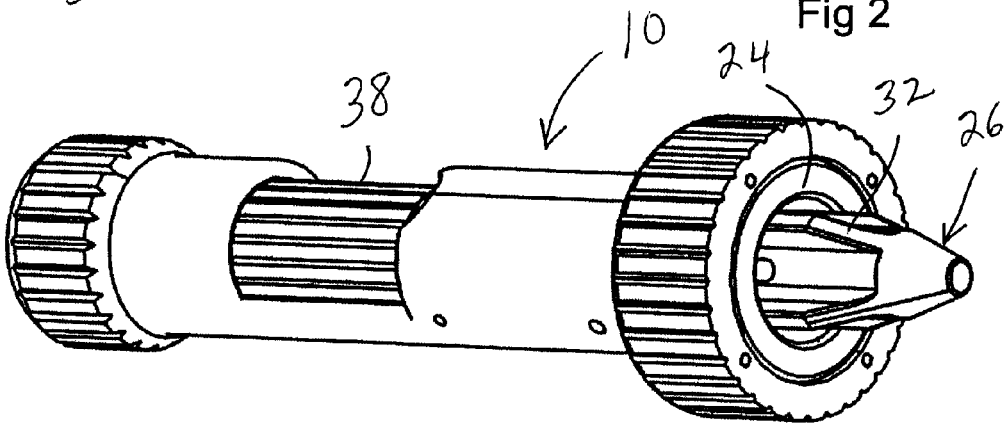
FIG. 2 is a rear perspective view of the bore sight showing the magnetic mating face and arbor.

With reference now to the figures, FIGS. 1-6 illustrate a bore sight 10 forming a first embodiment of the present invention. The bore sight 10 is used to align optical sighting devices, such as telescopic sights mounted on a firearm 12, by projecting a laser beam aligned with the centerline 14 of the bore 16 of the barrel 18 of the firearm 12. As will be described hereinafter, the bore sight 10 is secured on the end 20 of the barrel 18 during use, preferably by magnetic force. A significant advantage of the bore sight 10 is that it can be used without modification on a range of bore diameters, or calibers. Preferably, the bore sight 10 can be used with calibers in a range of .17 caliber to .50 caliber, corresponding to a diameter from 0.17 inches to 0.50 inches, with either rifles or handguns.

The bore sight 10 includes a housing 22, which includes a magnetic alignment face 24 for attachment to the end 20 of the barrel 18, and an arbor 26 which is urged into the bore 16 by a spring 28 within the housing 22. A laser 30 is also mounted within the housing for projecting a laser beam through the end of the housing 22 opposite the face 24. As will be described in greater detail, the laser beam of the laser 30 is aligned with the centerline of the arbor, which, in use, is aligned with the centerline 14 of the barrel 18, so that the laser beam gives a precise indication for aligning optical devices.

Figure 3:
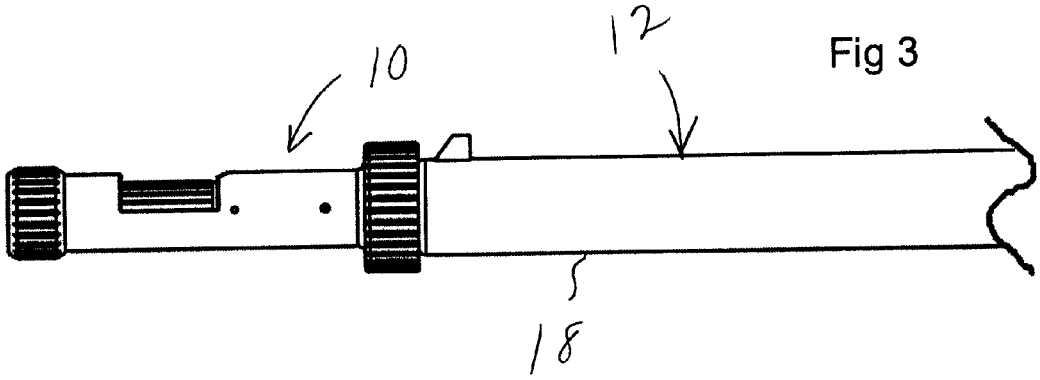
FIG. 3 is a view of the bore sight attached to the end of a firearm barrel, with the magnetic mating face attached to the end of the muzzle with the bore sight co-axially aligned with the bore of the firearm.
Figure 4:
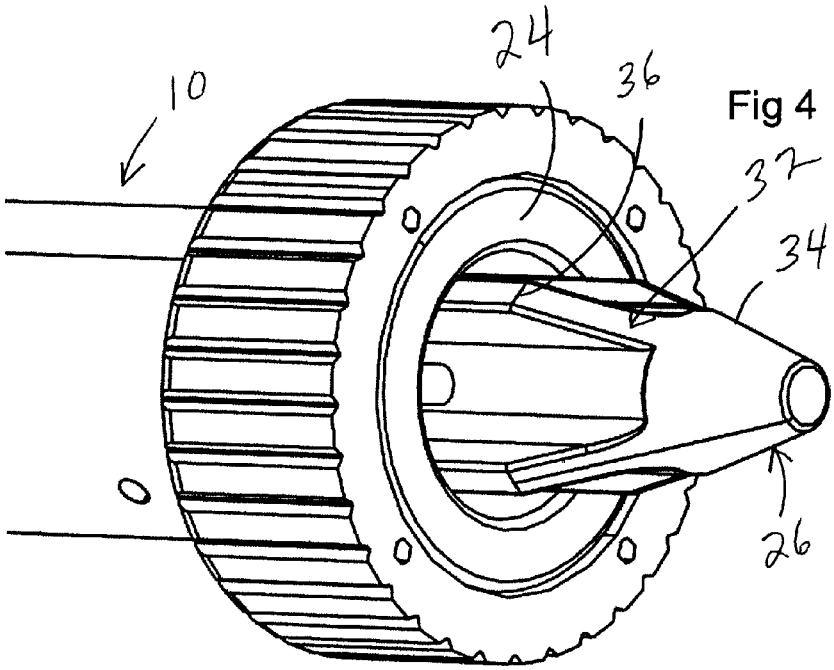
FIG. 4 is a view showing the arbor fully extended.
Figure 5:
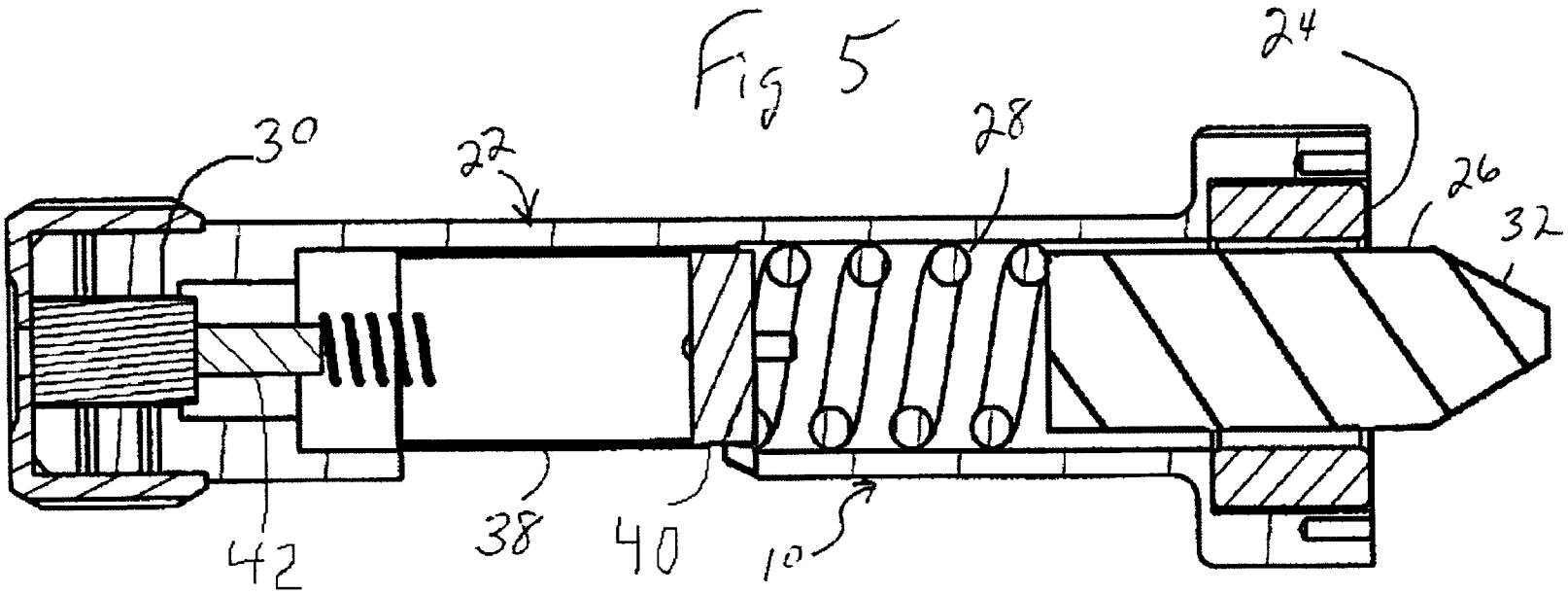
FIG. 5 is a cross-sectional view of the bore sight illustrating the spring acting on the arbor.
Figures 6A, 6B:
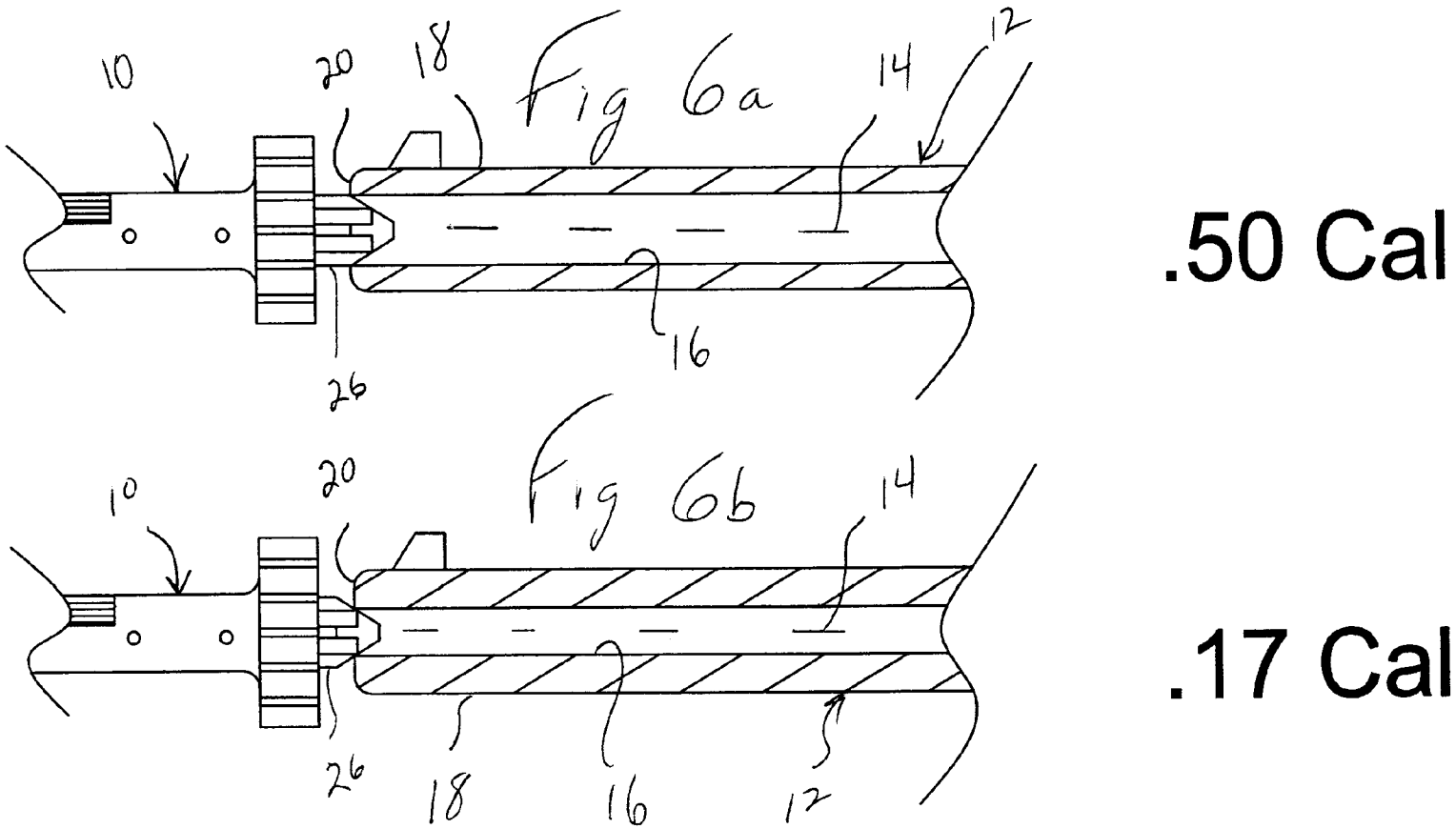
FIGS. 6*a* and 6*b* illustrate the bore sight being secured to a .50 caliber firearm and a .17 caliber firearm, respectively.

In use, the end of the tapered face 32 of the arbor 26 of the bore sight 10 is inserted into the end 20 of the barrel 18 as seen in FIGS. 6*a* and 6*b*. Depending on the caliber of the firearm 12, at least a portion of the tapered face 32 enters the barrel 18. However, due to the tapered face 32, only so much of the arbor 26 can enter the barrel 18 as corresponds to the caliber of the firearm 12. The arbor 26, or at least the tapered face 32, is made of a non magnetic material that will not damage the barrel 18, such as brass or plastic. After this point, as the housing 22 continues to be pushed toward the end 20 of the barrel 18, the arbor 26 starts to retract inside the housing against the force of spring 28. Eventually, the face 24 comes into contact with the end 20 of the barrel 18 and the strong magnetic force exerted by the magnetic face 24 holds the bore sight 10 on the firearm 12 as seen in FIG. 3. On most firearms, the barrel end is normal or perpendicular to the centerline of the bore of the barrel.

Thus, the distance the arbor 26 extends from the face 24 adjusts automatically as the bore sight 10 magnetically engages the barrel 18 to adapt the bore sight 10 to the particular caliber of the firearm. As the arbor 26 is inserted within the barrel 18, the centerline of the arbor 26, and thus the centerline of the laser beam of the laser 30, is automatically aligned with the centerline 14 of the bore 16. The tapered face 32 is tapered to allow alignment from a minimum diameter 34, preferably .17 caliber or 0.17 inches, to a maximum diameter 36, preferably .50 caliber or 0.50 inches. Clearly, this range of diameters can be varied as desired, but the range from 17 to 50 caliber is believed to allow use with the vast majority of firearms used today.

The bore sight 10 also has a battery compartment 38 to carry the batteries needed to power the laser 30, a switch 40 to turn the laser on and off and the circuitry 42 necessary to operate the laser.

As can be understood, the bore sight 10 provides a quick and accurate device for aligning optical devices. The bore sight 10 can be used with a range of bore diameters without the need for additional fixtures, assemblies, parts, adaptors or accessories to fit the different calibers. The arbor 26 will automatically adjust its depth as it is inserted into the barrel 18. As the depth is set, the arbor 26 aligns the optical axial center of the laser 30 with the centerline axis 14 of the firearm barrel 18. Of course, the bore sight 10 can be used with any type of bore to provide alignment as well, and is not limited to use with a firearm.

Any color laser 30 can be used with the bore sight 10. Preferably, a green laser is used as these are more powerful and can be seen farther away. Most if not all current systems for alignment can't use a green laser as it is to large and bulky for use in the packaging requirements of those systems. The bore sight 10 is not so restricted.

Figure 7:
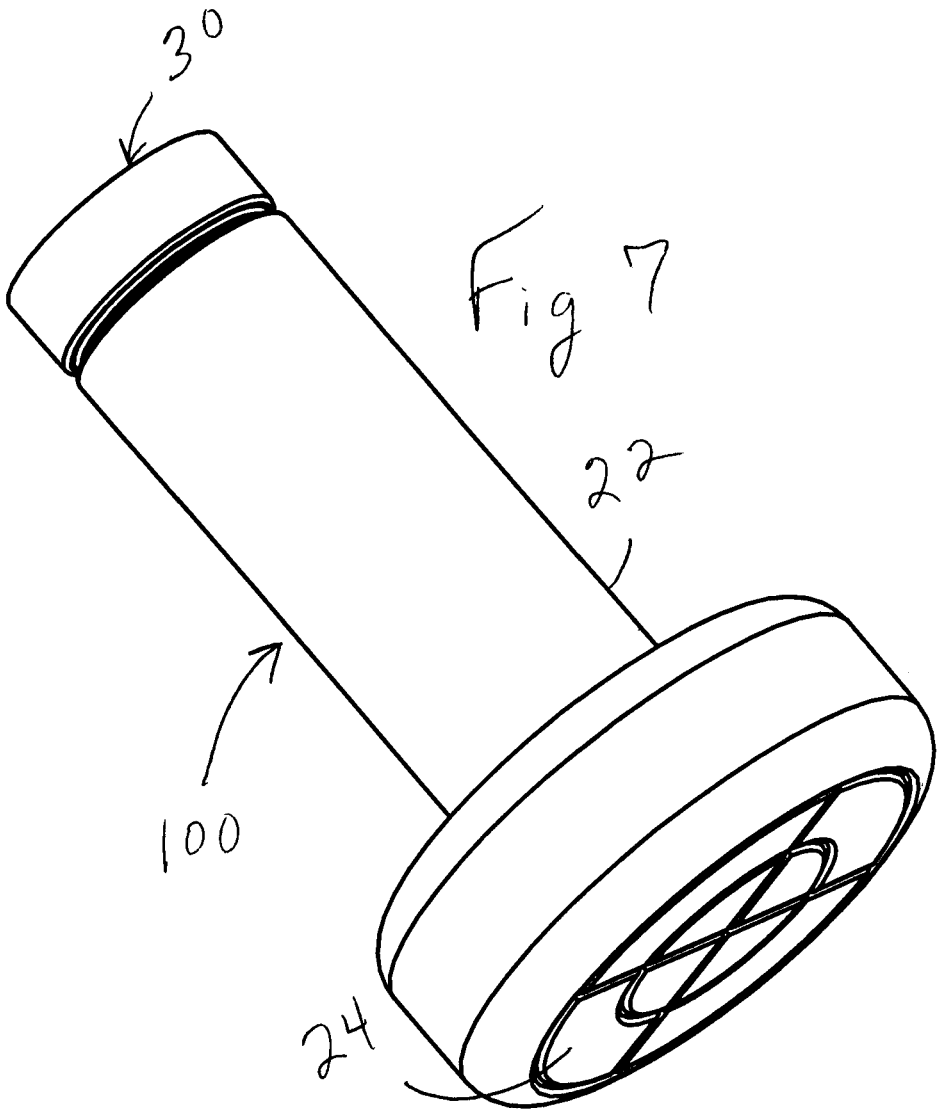
FIGS. 7 and 8 are rear perspective views of a bore sight forming a second embodiment of the present invention showing the magnetic mating face, and not using an arbor.
Figure 8:
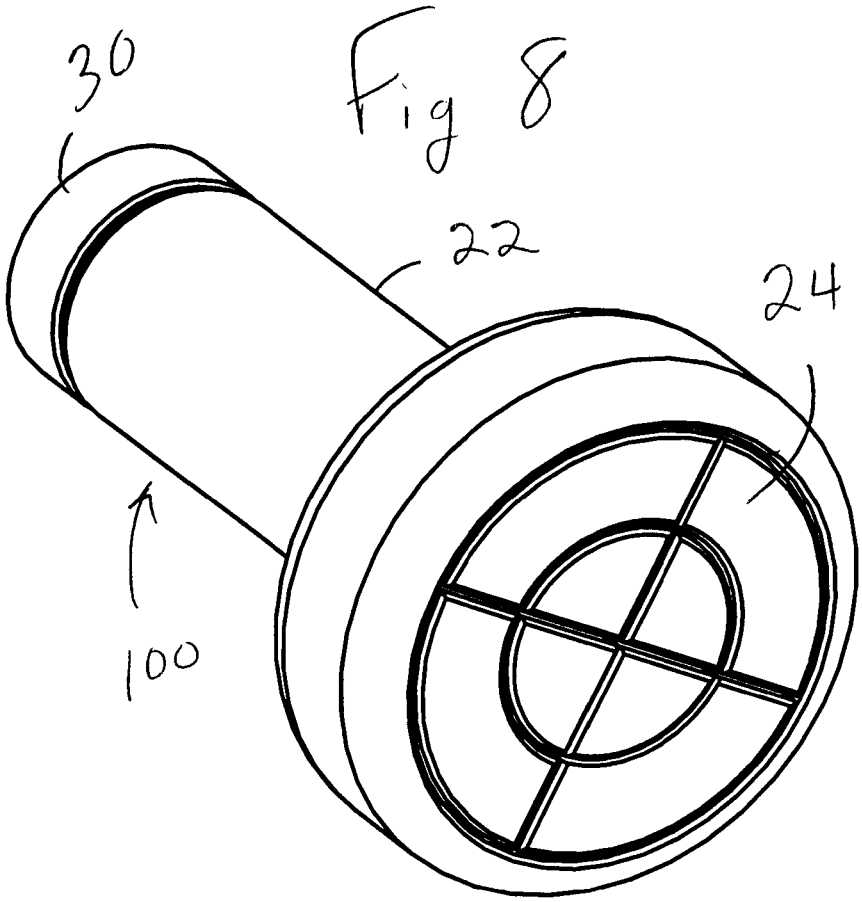

With reference to FIGS. 7 and 8, a bore sight 100 forming a second embodiment of the present invention will be described. The bore sight 100 does not include an arbor 26, but in all other aspects is identical to bore sight 10. In use, the magnetic alignment face 24 of the bore sight 100 is positioned on the end 20 of the barrel 18 and the bore sight 100 is hand centered to align with the centerline 14 of the bore 16. The laser dot generated by the laser 30 inside bore sight 100 is large enough at 100 yards to cover any discrepancies + or −5 mm from the centerline 14 and the bore sight 100.

While several embodiments of the present invention have been illustrated in the accompanying drawings and described in the foregoing Detailed Description, it will be understood that the invention is not limited to the embodiments disclosed, but is capable of numerous rearrangements, modifications and substitutions of parts and elements without departing from the scope and spirit of the invention.

The invention claimed is:

1. A bore sight for alignment with a member having a bore of predetermined diameter and an end having an annular surface lying in a plane generally perpendicular the centerline of the bore, the member being a firearm barrel, comprising:

a unitary housing having a planar surface lying in a first plane, the planar surface having concentric circles and a crosshair;

the bore sight positioned with the planar surface of the housing for contacting the annular surface at the end of the member, thereby aligning the bore sight with the centerline of the bore of the member and wherein the member is a firearm barrel, no portion of the bore sight insertable in the firearm barrel and no portion of the bore sight extendable through the firearm barrel; and a laser mounted in the housing that projects a beam aligned with a centerline of the bore sight, the laser beam being aligned with the centerline of the bore of the member when the centerline of the bore sight is aligned with the centerline of the bore of the member.

2. The bore sight of claim 1 wherein the housing has a magnet at the planar surface to secure the bore sight in engagement with the end of the member, the magnet sized to secure the bore sight to the end of the firearm barrel.

3. The bore sight of claim 1 further comprising a battery to power the laser mounted in the housing, a switch to turn the laser on and off mounted in the housing, and circuitry necessary to operate the laser mounted in the housing.

4. A bore sight in alignment with a firearm barrel having a bore of predetermined diameter and an end having an annular surface lying in a plane generally perpendicular the centerline of the bore, comprising:

a housing having a planar surface lying in a first plane and having a magnet at the planar surface to secure the bore sight in engagement with the end of the firearm barrel, the magnet sized to secure the bore sight in engagement with the end of the firearm barrel, the housing defining a centerline perpendicular the planar surface;

a laser fixedly mounted in the housing and projecting a laser beam along the centerline of the housing, the laser beam being aligned with the centerline of the bore of the firearm barrel when the centerline of the housing is aligned with the centerline of the bore of the firearm barrel; and the bore sight positioned by hand with the planar surface of the housing in contact with the annular surface at the end of the firearm barrel, aligning the bore sight with the centerline of the bore of the firearm barrel, no portion of the bore sight insertable within or through the firearm barrel, the planar surface having concentric circles and a crosshair.

5. The bore sight of claim 4 further comprising a battery to power the laser mounted in the housing, a switch to turn the laser on and off mounted in the housing, and circuitry necessary to operate the laser mounted in the housing.

6. A method for aligning a bore sight to the centerline of a bore of predetermined diameter in a firearm barrel, the firearm barrel having an end with an annular surface lying in a plane generally perpendicular the centerline of the bore, comprising the steps of:

moving a planar surface of a housing of the bore sight into magnetic contact with the annular surface at the end of the firearm barrel, the planar surface lying in a first plane, the housing fixedly mounting a laser projecting a laser beam along a direction perpendicular the first plane defining the centerline of the bore sight; and aligning by hand the centerline of the bore sight with the centerline of the bore of the firearm barrel while the planar surface of the housing of the bore sight is in magnetic contact with the annular surface at the end of the firearm barrel to align the bore sight to the centerline of the bore of the firearm barrel, the hand alignment being unrestricted within the plane of the planar surface.

7. The method of claim 6 further comprising the step of activating the laser beam from the laser mounted in the housing.

* * * * *